US006868756B2

(12) United States Patent
Kozak

(10) Patent No.: US 6,868,756 B2
(45) Date of Patent: Mar. 22, 2005

(54) DEVICE TO EXTRACT BROKEN FASTENERS EMBEDDED IN A WORKPIECE

(75) Inventor: Ira M. Kozak, Chicago, IL (US)

(73) Assignee: Combined Products Incorporated, Chicago, IL (US)

( * ) Notice: Subject to any disclaimer, the term of this patent is extended or adjusted under 35 U.S.C. 154(b) by 0 days.

(21) Appl. No.: 10/365,334

(22) Filed: Feb. 12, 2003

(65) Prior Publication Data

US 2004/0154438 A1 Aug. 12, 2004

(51) Int. Cl.[7] ..... B24B 13/48; B25B 23/10
(52) U.S. Cl. ..... 81/53.2; 81/441
(58) Field of Search ..... 81/53.2, 441, 121.1, 81/124.2, 451, 438

(56) References Cited

U.S. PATENT DOCUMENTS

| | | | | | |
|---|---|---|---|---|---|
| 1,683,796 | A | * | 9/1928 | Pearce | 81/53.2 |
| 1,815,500 | A | * | 7/1931 | Doan | 81/53.2 |
| 2,013,923 | A | * | 9/1935 | Naccarato | 81/441 |
| 2,694,328 | A | * | 11/1954 | Lafreniere | 81/53.2 |
| 3,678,789 | A | * | 7/1972 | Wilson | 81/121.1 |
| 3,735,650 | A | * | 5/1973 | Weng, Jr. | 81/53.2 |
| 4,078,458 | A | * | 3/1978 | Berendzen | 81/441 |
| 6,047,620 | A | * | 4/2000 | Kozak et al. | 81/441 |

* cited by examiner

*Primary Examiner*—Hadi Shakeri
(74) *Attorney, Agent, or Firm*—Cherskov & Flaynik

(57) ABSTRACT

A device for the extraction of broken fastener comprises a left handed cutting tool juxtaposed to a left handed drill bit that is surrounded by a socket. In a specific embodiment the socket has longitudinal slits, a ribbed inner surface, and a threaded outside surface adapted to be received by a collar.

4 Claims, 7 Drawing Sheets

DEVICE TO EXTRACT BROKEN FASTENERS EMBEDDED IN A WORKPIECE

BACKGROUND OF THE INVENTION

1. Field of the Invention

The present invention relates to the field of tools for removing broken or frozen fasteners from a workpiece and, more particularly, to devices that remove rotary fasteners by applying a torque in a direction opposite to that initially necessary to drive the fastener into the workpiece.

2. Background of the Invention

To extract a broken fastener embedded in a workpiece, one often begins with a device to rotatably engage the head of the fastener. Other tools forcibly pull out or bore out the fastener.

Devices currently exist to extract head-less screws and other broken fasteners still embedded in a workpiece. Typically these devices include drilling tools that bore into the fastener. See U.S. Pat. No. 6,081,983 awarded to Hogson, et al. (2000), U.S. Pat. No. 5,546,834 awarded to Gable et al (1996), U.S. Pat. No. 5,544,987 awarded to Gipson (1996) U.S. Pat. No. 5,279,187 awarded to Salmon (1994).

As the tool bores into the fastener, it is hoped that the largest portion of the applied torque imparts a fastener-extracting force to the fastener. However, in actuality a large portion of the torque results in the tool being forced further into the fastener and the workpiece. This further penetration into the workpiece does not necessarily facilitate eventual extraction of the fastener but instead may result in damage to the workpiece.

There are devices that comprise a left handed cutting tool at one end and a left handed drill bit at the other. See for instance U.S. Pat. No. 5,031,487 awarded to Polonsky on Jul. 16, 1991. These devices have several disadvantages, including: (a) the necessity for manual handling of the device when switching from use of the cutter to use of the drill bit; (b) exerting a torque along the axis of the fastener rather than exerting a torque on the fastener's periphery—the best arrangement being the simultaneous exertion of a torque along the axis and on the periphery; and (c) the difficulty of finding a point where a power tool may grip the device. Another disadvantage in the prior art is that there is insufficient control of the direction in which the device acts. Sudden changes in the resistance offered to the tool result in changes in the direction in which the tool bores into the fastener or applies an extracting torque thereto.

A need exists in the art for a device to remove broken fasteners from a workpiece that would maximize the amount of torque that is applied to the fastener and ensure rapid, smooth, and safe operation. The device should combine the application of torque along the periphery of the fastener with application of torque at the longitudinal axis of the fastener.

SUMMARY OF THE INVENTION

It is an object of the present invention to provide a device to remove broken or frozen fasteners from a workpiece that overcomes many of the disadvantages of the prior art.

It is a further object of the present invention to provide a device to remove broken fasteners from a workpiece that maximizes the amount of torque that may be applied to remove a fastener. A feature of an embodiment of the invention is a drill-bit/cutting-tool surrounded by a socket which abuts against the fastener-workpiece interface and which may be used to apply torque to the periphery of the fastener. An advantage of the present invention is that at a given point the socket prevents further penetration of the device into the workpiece at the same time as it allows penetration of the drill bit portion of the device into the shank of the fastener thus imparting torque to an interior portion of the fastener shank. The result is that a large portion of the torque imparted to the device is used for the extraction of the fastener.

Another object of the present invention is to provide a device to remove broken fasteners from a workpiece that operates reliably. A feature of the present invention is an axially symmetric socket that abuts against the workpiece at a certain distance from where the device engages the fastener. Longitudinally extending portions of the socket may be cylindrical or conical (the latter to allow for fasteners with variable diameters). An advantage of the present invention is that it stabilizes the device in a direction perpendicular to the plane defining the fastener-workpiece interface.

Still another object of the present invention is to provide a device to remove broken right-hand (i.e. clockwise) fasteners from a workpiece that allows the convenient successive use of a left handed cutting tool and a left handed drill bit. It is a feature of the present invention that it comprises a shaft terminated by a left handed cutting tool which is integrally molded, or otherwise in communication with, a left handed drill bit. The reverse of this configuration is utilized to extract a left-handed fastener. An advantage of the present invention is that the drill bit is engaged during or after the cutting tool's action is completed without the need for any different movements or implements required by the user.

A further object of the present invention is to provide a method to remove broken fasteners from a workpiece that allows applying torque to the periphery of the fastener at the same time as torque is applied in the interior of the fastener. A feature of the present method is that it provides cutting action in a pre-determined direction of rotation, followed by, or simultaneous with, drilling action in the same pre-determined direction. Extracting torque is applied to the interior of the fastener while a socket rotational torque is applied to the exterior of the fastener. An advantage of the present invention is that two different portions of the fastener are acted upon to facilitate its extraction.

Yet a further object of the present invention is to provide a device to remove broken fasteners from a workpiece that allows cutting of the workpiece around the periphery of the fastener at the same time as torque is applied directly to the shank of the fastener. A feature of the present invention is a rotating elongated member terminating at a first end with a left handed cutting tool, the latter in communication with a proximally-located left handed drill bit. An advantage of the invention is that once in contact with the workpiece, the cutting tool confines the bit to a predetermined orientation relative to the workpiece while simultaneously isolating the bit within the confines of the cutting tool so as to prevent injury to the user.

Briefly, the invention provides a device to remove a fastener from a workpiece, the device comprising a rotatable shaft with a left handed cutting tool followed by a left handed drill-bit adapted to engage and bore into the fastener as the shaft is rotated counterclockwise; and a socket coaxial with and attached to the shaft at a point between the drill-bit portion and the point where the shaft is rotated, with interior surfaces of said socket defining a cavity.

BRIEF DESCRIPTION OF THE DRAWING

The foregoing invention and its advantages may be readily appreciated from the following detailed description of the invention, when read in conjunction with the accompanying drawing in which.

DETAILED DESCRIPTION OF THE INVENTION

The present invention provides a device to remove broken fasteners from a workpiece. In general terms, the device comprises a drill used in cooperation with a socket to provide removing torque along different regions of a recalcitrant fastener. With suitable modifications, the device may be used to remove either right-handed or left-handed broken fasteners. The device can be either manually-driven or power-driven.

For the sake of simplicity, this description will emphasize the removal of right handed fasteners. However, left-handed fasteners also can be accommodated with the invented device configured with a right-handed cutting tool and a right-handed drill bit.

The present invention provides alternate means for fastener removal: In one configuration the fastener is removed without the socket penetrating into the workpiece in which the fastener is embedded. In another configuration the fastener is removed while the socket penetrates into the workpiece. The tool user has the option of using the non-penetrating configuration first and resorting to the second configuration when circumstances require it. An advantage of using a penetrating socket is that during fastener extraction, a smooth, circular score is made around the circumference of the fastener in the workpiece in a direction parallel to the fastener's longitudinal axis. When the fastener is finally extracted, the cavity defined by the score can be filled with a plug of the same (or different) material as the workpiece (wood, metal, plastic, etc.), thereby facilitating reassembly for a cosmetically pleasing result.

Figure 1A:
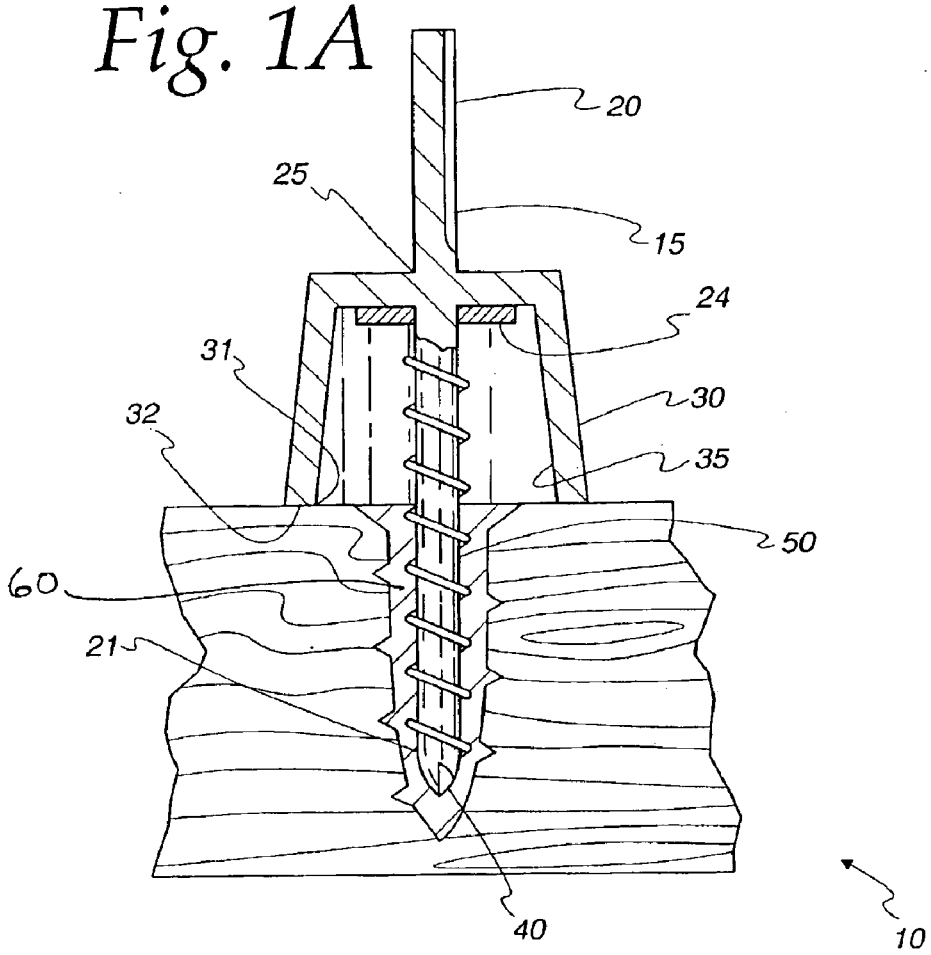
FIG. 1A is a cross-sectional view of a first embodiment of a device for removing a fastener from a workpiece in accordance with features of the present invention.

As shown in FIG. 1A, the invented device generally designated as 10, comprises a cylindrical shaft 15 with a first end 20 and a second end 21. The first end 20 is adapted to be received by a power-driven tool or a hand-actuated handle. As such, the cross-section of the first end 20 can be polygonal or circular, and can be further modified to define a key-way 22 to enhance gripping with a rotating chuck (not shown) or some other rotating means.

The second end 21 of the shaft is generally configured as a drill bit 50. The drill bit is shown embedded into a fastener 60.

A cylindrical or conical socket 30 is positioned coaxial with the shaft 15 and terminates in a rim 31 extending distally, i.e., in a direction opposite the first end 20 of the shaft. The socket can be a static object with no moving parts, rather only containing a polished surface to facilitate slipping over a workpiece or a serrated surface to effect cutting into the workpiece. Alternatively, the socket can be a collet adapted to threadably receive a constriction ring along an exterior surface of the collet.

Irrespective of the additional functionality of the cutting tool (the socket), the rim 31 of the socket generally defines a distally-facing surface 32 which, depending on the application, may be smooth (i.e., the polished surface noted supra), serrated, fluted, or provided with teeth.

Furthermore, and as discussed more fully below, and depicted in FIG. 4A, an inwardly facing surface 35 of the socket 30 may comprise ribs 33, flutes, or be other-wise configured to enhance its mechanical or frictional engagement with the periphery of a fastener's head.

Figure 1B:
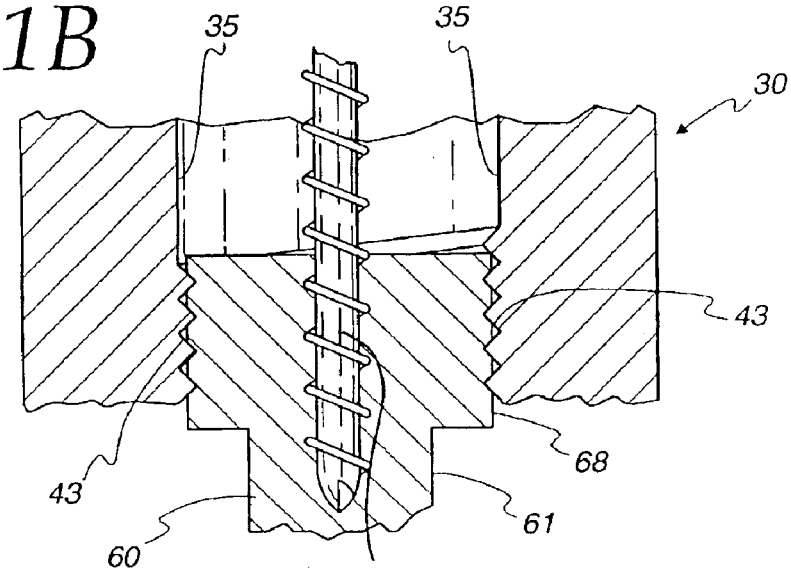
FIG. 1B is a cross-sectional partial view of a detail of a first embodiment of a device to remove a fastener from a workpiece, in accordance with features of the present invention.

Also as shown in FIG. 1B, the inside surface 35 of the socket 30 may be configured as a die with a self-tapping thread 43 that enhances engagement between the socket 30 and either the head 68 or the shank 61 (if the head has been broken off) of the fastener 60.

The socket communicates with the shaft 15 at a point 25 intermediate the first end 20 and second end 21 of the shaft. The socket 30 may be integrally molded (e.g. welded, casted, or forged) to the shaft, or reversibly connected thereto via a set screw or locking collar, or a male-female threaded configuration.

Figure 3A:
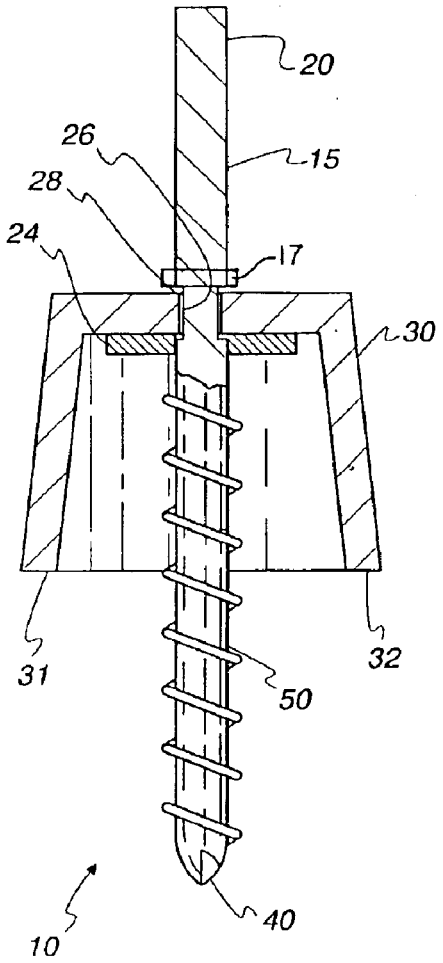
FIG. 3A is a cross-sectional view of a modified first embodiment of a device to remove a fastener from a workpiece, in accordance with features of the present invention.
Figure 3B:
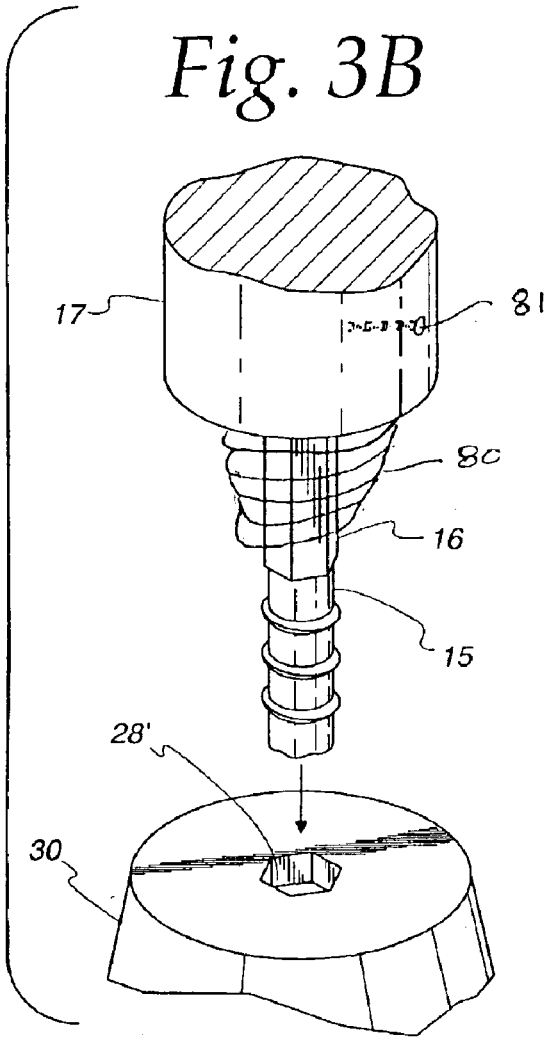
FIG. 3B is a cross-sectional view of a detail of a modified first embodiment of a device to remove a fastener from a workpiece, in accordance with features of the present invention.

Alternatively, and as shown in FIG. 3A, the socket may be retained between radially projecting portions or shoulders 17 of the shaft so as to allow free rotation of the shaft 15 with respect to the socket 30. A shoulder 17 on the shaft, external of the internal void defined by the socket, may be spring biased (via a spring situated intermediate the shoulder and the socket) so as to confer distally extending pressure to the socket. This allows motion of the socket along the axis while pressure is applied to the shaft. To assure simultaneous rotation of the shaft with the socket in this scenario, a cross section 16 of the shaft may be adapted to be received by a similarly configured aperture defined by a region on an upwardly facing surface of the socket. For example, and as depicted in 3B, a hexagonal cross section 16 of the shaft 15 is slidably received by a hexagonal shaped aperture 28' formed in a region of the socket. FIG. 3B shows a spring 80 intermediate the socket and the shoulder 17. It should be noted that the external shoulder 17 can either integrally molded to the shaft or else reversibly attached to the shaft via a ball-detent mechanism, a screw collar configuration, or similar collar attachment means.

Extending from the shaft 15 is a left handed drill bit portion 50 that terminates in a left handed cutting tool 40 (as noted supra, for the sake of illustration, it is assumed that the fastener to be removed is right handed). This drill bit can either be solid throughout (i.e., a typical drill bit) or the drill bit can define a hollow interior accessible from its tip (i.e., the location of the cutting tool 40). The hollow interior is adapted to slidably receive center pins typically found on commercially available security screws, also known as tamper resistant screws. The hollow bit encapsulates the pin as the bit bores through the pin shank for ultimate removal of the fastener.

Figure 2:
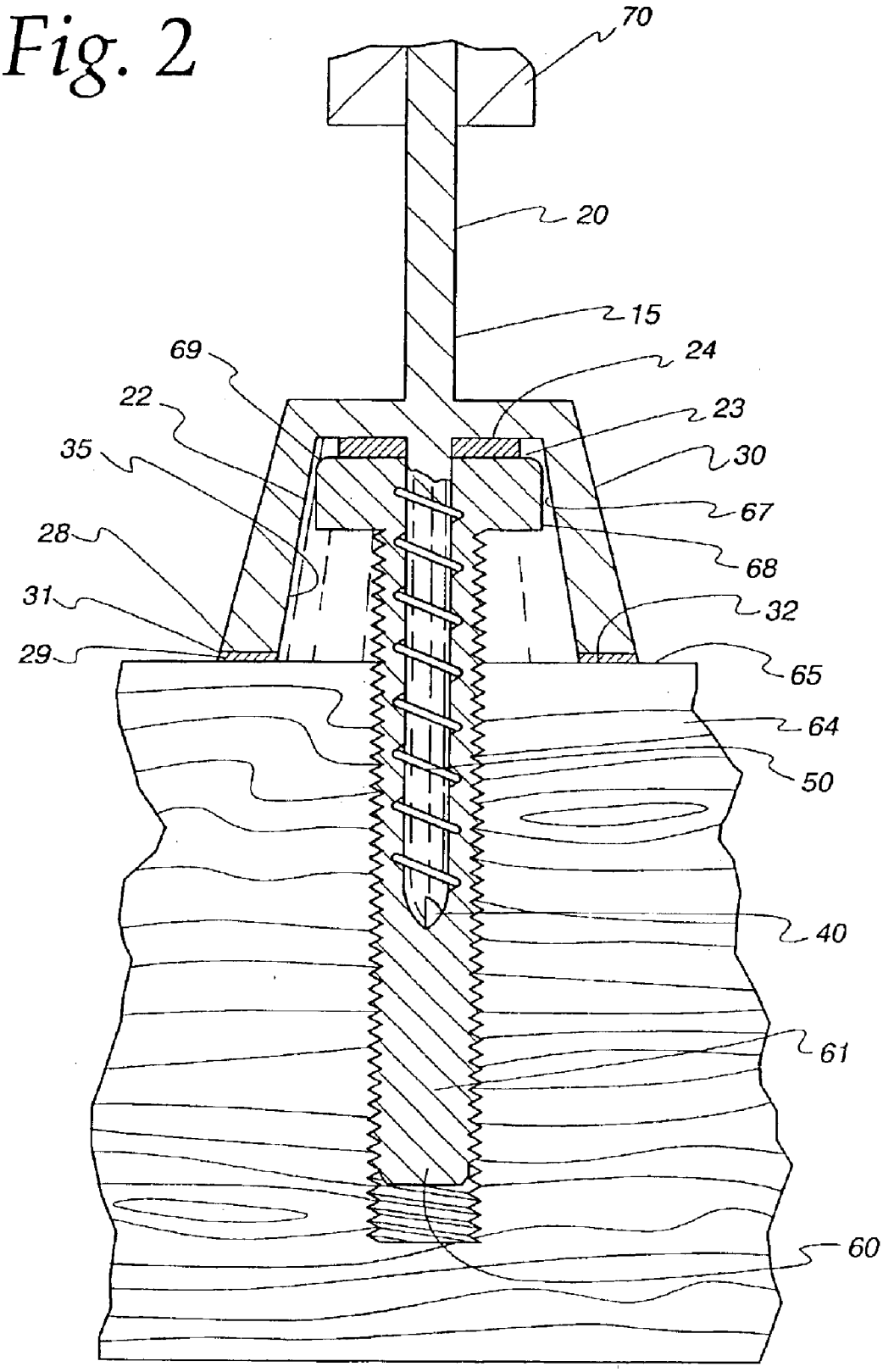
FIG. 2 is a cross-sectional view showing the use of a device removing a partially extracted fastener from a workpiece, in accordance with features of the present invention.

FIG. 2 illustrates how the device is used. FIG. 2 depicts the cutting tool 40 and the drill bit portion 50 having penetrated the fastener 60 deep enough for the surface 32 on the rim 31 of the socket 30 to abut or otherwise contact the surface 65 of the workpiece 64. Torque is provided by a rotating portion (such as a chuck) of the power tool 70. The first end 20 of the shaft 15 is adapted to be received by the power tool.

In the device depicted in FIG. 2, whereby the depending lip 32 of the socket has a smooth topography, the socket 30 prevents further penetration of the device into the workpiece 64. Rather, the device rotates as the surface 32 slides on the workpiece surface 65, so that the drill bit 50 can penetrate further into the fastener 60 only as the fastener is extracted from the workpiece 64 towards the power tool 70. Frictional engagement between the fastener 60 and the bit 50 may be enhanced by the use of a tapping bit. This will confer additional extracting functionality whereby the bit would be able to impart upon the fastener an axial force by the user, as well as a rotational force.

Optionally, the sliding of the socket rim surface 32 over the workpiece surface 65 is facilitated by lining the rim surface 32 with a friction-reducing material 29 such as polytetrafluoroethylene (e.g. Teflon®), by installing roller bearings on the rim surface, or by providing the rim surface 32 as a polished surface without sharp edges thereon. Optionally, a "radius" (i.e. an upward sloping section directed tangentially to the circular rim) on a leading edge of the socket rim would allow smooth socket travel over irregularities on the workpiece surface. As shown infra, the same low friction feature may be obtained by providing the socket with an annular aperture at the point where the socket communicates with the shaft so as to allow rotation of the shaft with respect to the socket. Again the socket aperture or the shaft may be lined at this point with friction-reducing materials.

As extraction of the fastener 60 proceeds, the fastener head 68 comes to rest against an interior surface 23 of the socket 30 at a point determined by the diameter of the fastener head 68. Optionally, regions of the interior surface 23 friction enhancing structures such as ribs, flutes, teeth, knurls, etc . . . A gasket or ring 24 consisting of a spring or of suitable pliable or reversibly deformable material in the interior surface 23 of the socket 30 may be used to provide a means for a rotating force to be exerted on top and/or periphery of the head 68 of the fastener via friction between the ring 24 and the fastener head 68 (or the shank 61 of the fastener 60, if the head 68 has been broken off). Alternatively, engagement of the socket with the head of the fastener may also be effected by having the socket define a conical inside surface 35 that is fashioned so as to grip the periphery of the head 68 or shank 61 of the fastener 60 once it reaches a point 67 on the inside surface of the socket. This can be accomplished by providing a rough friction enhancing surface that may include flutes or ribs 33 (see FIG. 4A) or other roughness imparting structures, on the inside surface 35 of the socket as noted supra.

An alternative means of juxtaposing the socket with the shaft is depicted in FIG. 3A. This configuration differs from the one shown in FIG. 1 in that the socket 30 is free to rotate azimuthally around the shaft 15. This is accomplished by providing a channel 26 about the circumference of the shaft adapted to receive medially directed portions 27 of the socket, said portions generally perpendicular to the longitudinal axis of the shaft and the socket. This axial rotation may be facilitated by juxtaposing a ball bearing-containing annulus intermediate the channel 26 and medially directed portions 27, or by lining the channel 26 with a friction-reducing material such as Teflon. In this configuration, the shaft is neither integrally formed with the socket or reversibly locked in axial rotation with the socket. Rather, the shaft is in rotatable communication with the socket. The socket is inserted through the first end 20 of the shaft 15 and prevented from moving back towards the first end 20 by means of a split ring inserted in the channel 26 or a set-screw held ring just above the channel 26, the latter taking the form of the reversibly-attached shoulder 17 discussed supra. This arrangement allows adjustment of the socket position along the shaft 15.

Figure 4A:
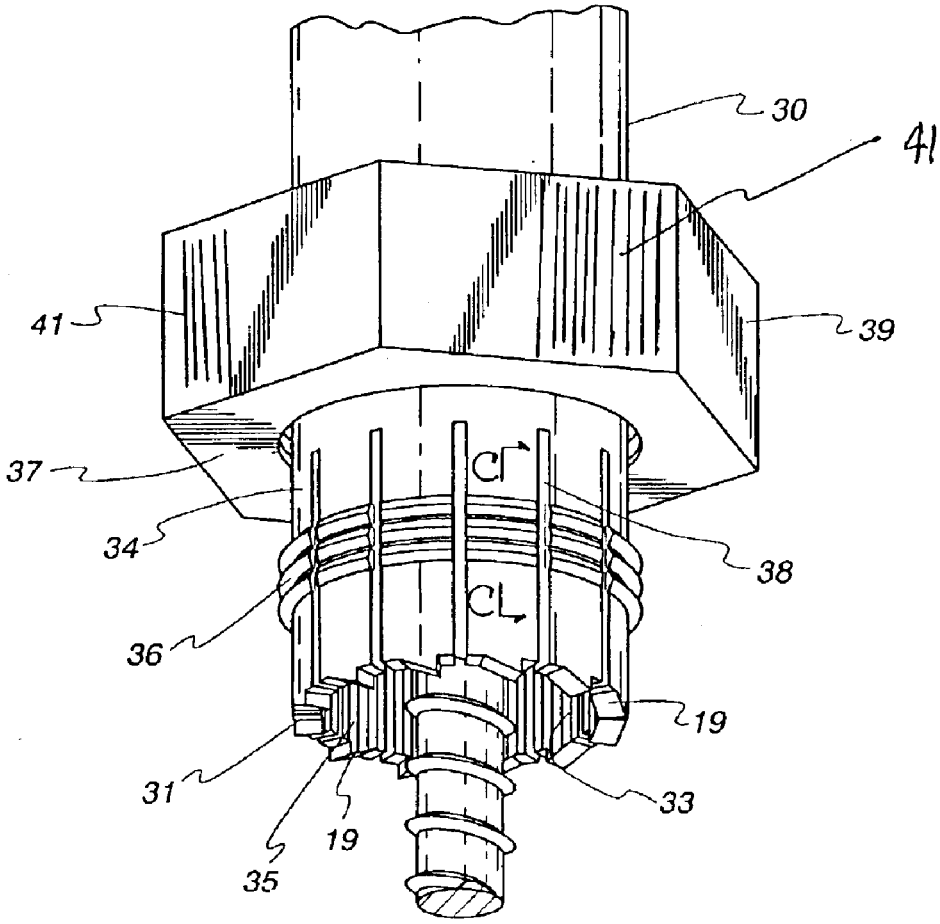
FIG. 4A is an elevational view of another embodiment of a device to remove a fastener from a workpiece in accordance with features of the present invention.

A second embodiment, shown in FIG. 4A differs from the one shown in FIG. 1 in that the socket 30 is specifically adapted to grip the periphery 69 of the head 68 of the fastener 60. The socket 30 is of a cylindrical shape with an inside surface 35 and an outer surface 34. The inside surface 35 has a diameter that complements the diameter of the periphery 69 of the head 68 of the fastener. The inside surface 35 comprises ribs 33 or other friction enhancing means designed so as to grip the periphery 69 of the head 68 of the fastener once the extraction of the fastener has begun (See FIG. 4B). Also, the outer surface 34 of the socket may have a rough, knurled or polygonal shape so as to allow application of torque thereto by means of a wrench when necessary.

As shown in FIG. 4A, the socket's gripping action may be enhanced by providing on the outer surface 34 a male-threaded section 36 designed to be received by a coaxial female-threaded collet collar 37 positioned on the socket 30. In this instance, longitudinally extending portions of the socket define one or a plurality of slits 38 which are parallel the longitudinal axis of the socket. The gripping action of the socket upon the peripheral region of the fastener head or shank is therefore enhanced as the collet collar is threaded onto the socket and advanced toward the workpiece. This collet-socket configuration also allows for an inside surface of the collet to define a cone, while the outside surface of the collet resembles a cylinder.

Figure 4B:
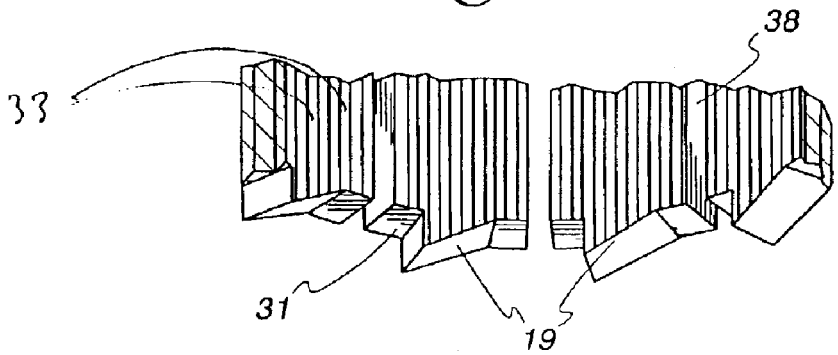
FIG. 4B is a detailed view of the rim of an embodiment of a device to remove a fastener from a workpiece in accordance with features of the present invention.
Figure 4C:
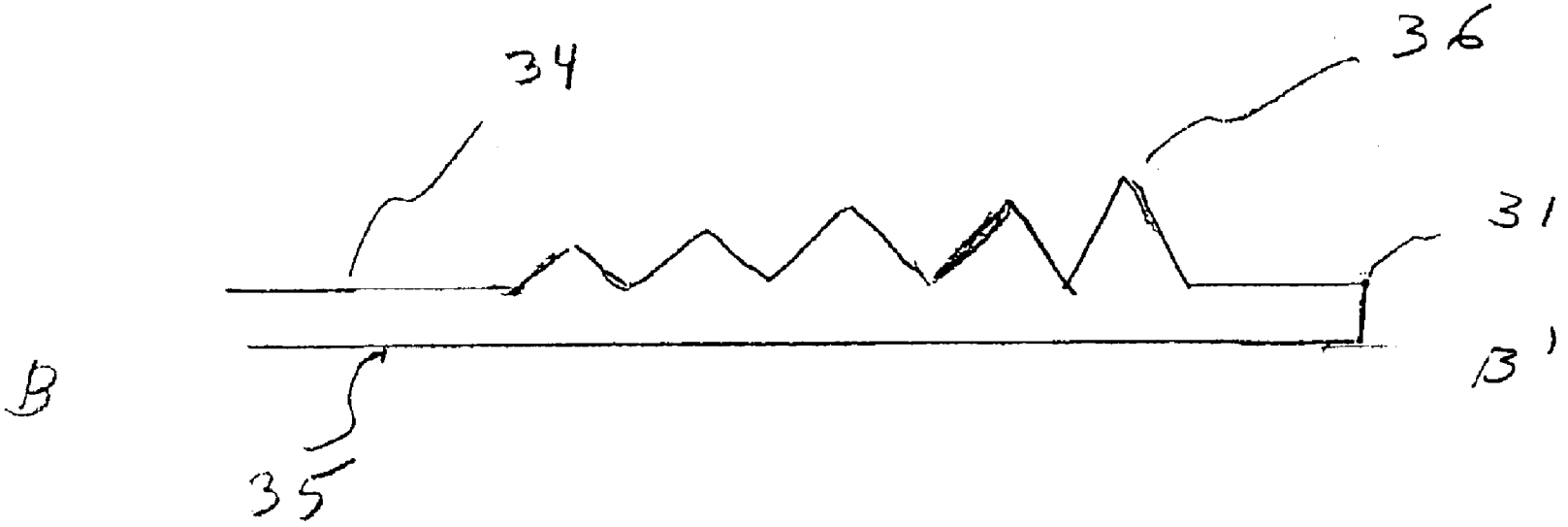
FIG. 4C is a detailed view of the surface of an embodiment of a device to remove a fastener from a workpiece in accordance with features of the present invention.
Figure 4D:
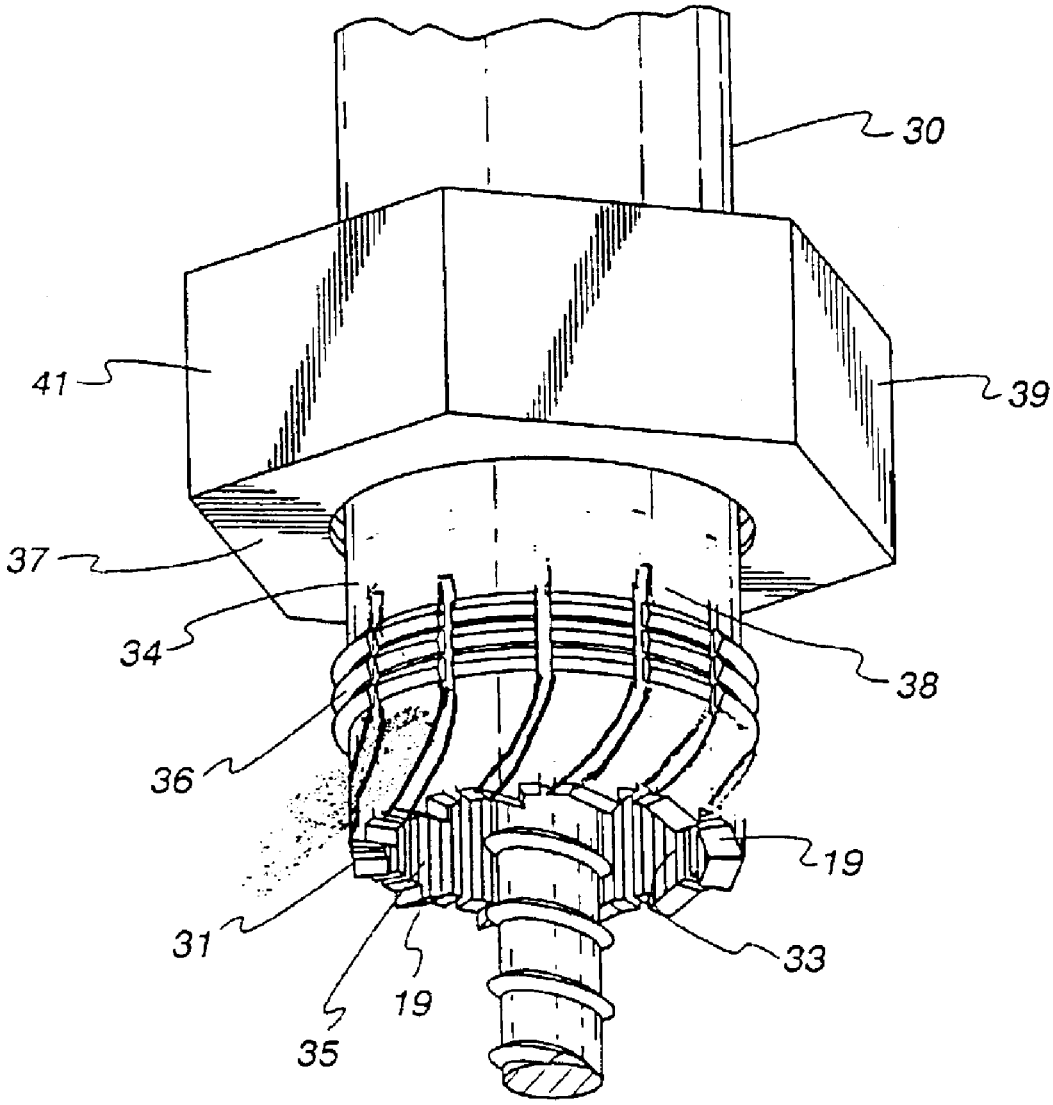
FIG. 4D is an elevational view of an alternate embodiment of a device to remove a fastener from a workpiece in accordance with features of the present invention.
Figure 4E:
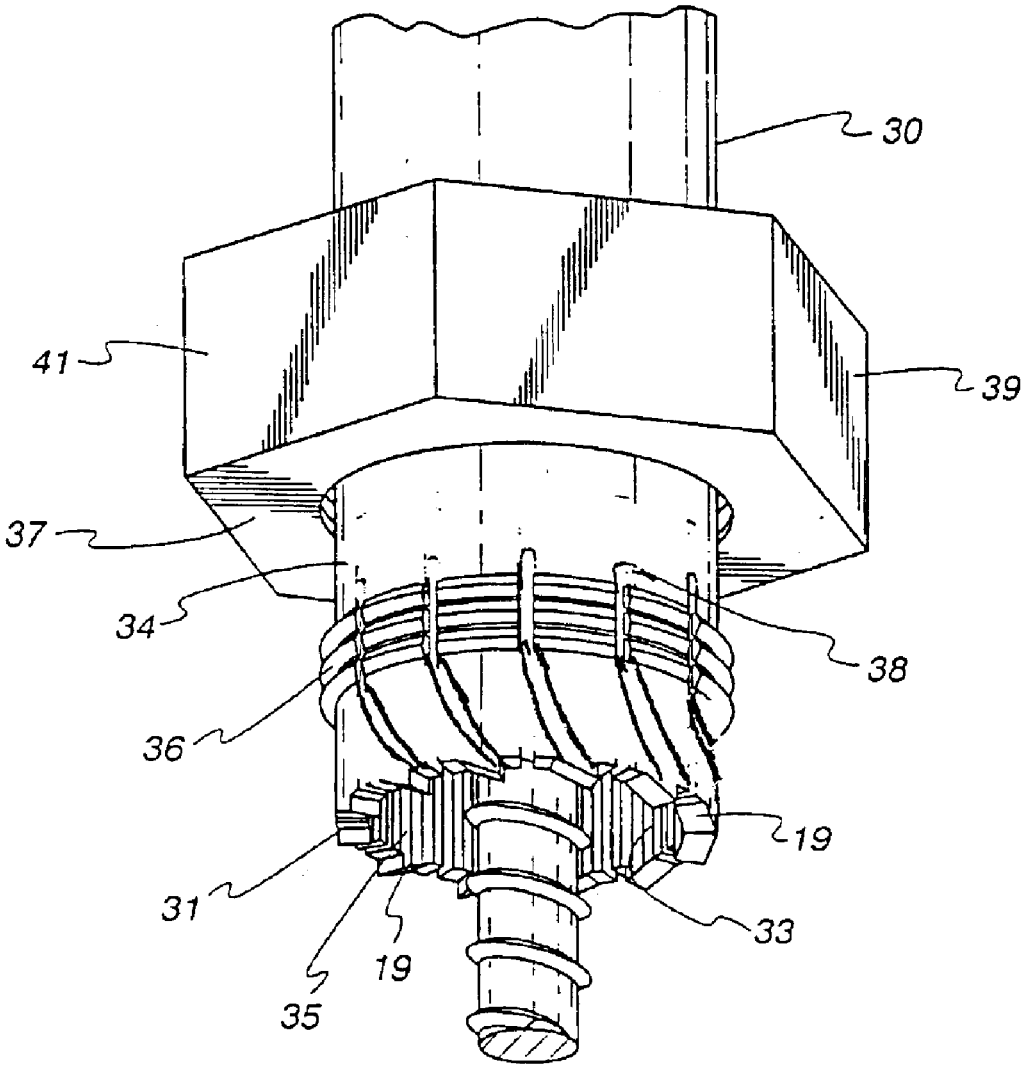
FIG. 4E is an elevational view of an alternate embodiment of a device to remove a fastener from a workpiece in accordance with features of the present invention.

The slits 38 in the socket 30 may extend rectilinearly parallel to the shaft 15 or assume right-handed or left-handed helical configurations (see FIGS. 4D and 4E). This rectilinearly parallel extension may continue partway along the socket surface and then deviate to a right-handed or left-handed helical configuration. The resiliency in the sockets-with-slits configurations may in and of itself provide sufficient engagement of the fastener head with the socket so as to make tightening of the collet unnecessary.

A particularly advantageous collet thread configuration is illustrated in FIG. 4C. FIG. 4C depicts a detail of a cross-sectional view along the line C—C of FIG. 4A showing a male-threaded section 36 wherein the height of the thread's protrusion above the surface 34 increases the closer the thread is to the rim 31 of the collet socket. In this configuration, advancing the collet collar 37 towards the rim 31 produces a narrowing of the slits 38 and a corresponding decrease in the diameter of the inside surface 35 of the socket 30.

FIG. 4A depicts a configuration where the collar 37 has a knurled outer surface or fluted surface 41 so that the collar 37 may be tightened by hand. Pliers, a wrench or some other tool may also be used, an operation that is facilitated if the outer surface 41 of the collet collar 37 comprises rectangular faces 39 in the form of a hexagonal nut, or some other grip-friendly topography.

Where it is not necessary to avoid cutting into the workpiece, a socket that cuts into the workpiece offers distinct advantages. This is the case for both of the above socket embodiments, but especially so for the fastener gripping embodiment. This is shown in FIG. 4B where the socket rim 31 comprises left handed cutting teeth 19.

Single socket-size configurations have been described supra. But it may be desirable to be able to remove, replace, or interchange the sockets. Removable-socket arrangements have been described supra. Other possible means of attachment is for the socket 30 to define a female left-hand-threaded aperture that is threaded upon a matching male threaded section of the shaft 15. In yet another method for attaching the socket, the socket defines a hexagonal (or other polygonal) opening 28' that may slidably accept a matching portion 16 of the shaft until the socket comes to abut the shoulder 17 which may be integrally molded with the shaft or held in place by a set screw 81. (See FIG. 3B). The socket may be held in place by a set screw, a ball detent mechanism, or a force along the axis applied by the user. One advantage of a temporary attachment for the socket is that it allows first the use of the first embodiment of the invention, where the socket is used to apply pressure to the workpiece until a sufficient portion of the fastener is extracted and then that socket is replaced with a fastener gripping socket such as a conical socket or a collet described supra. This allows the user to take advantage of the features of both embodiments. Interchange of sockets is facilitated when provision is made for the shaft to be inserted into the socket via the first end 20 (so that socket exchange may be accomplished while the drill bit portion 50 of the device is simultaneously engaged with the fastener), in which case provision must be made for a firm attachment of the socket to the shaft. More importantly, inasmuch as the second or "fastener gripping" embodiment requires that the socket inner diameter exceed but very slightly the diameter of the fastener head, operators of the invented device may satisfy multiple needs with a kit comprising only one cutting tool/drill bit shaft together with an assortment of sockets of different inner diameters and different surface configurations.

A variety of materials are suitable for the drill bit portion of the invented device. The requirements are slightly different from those for ordinary cutting tools and bits in that here greater friction between the drill bit device and the surrounding fastener material is required. Thus the use of a high grade carbide steel drill is not always necessary. One possible embodiment is one where the drill bit portion 50 is tapered. Another possible embodiment would comprise a tapping drill bit.

The foregoing description is for purposes of illustration only and is not intended to limit the scope of protection accorded this invention. The present invention may be presented in other specific embodiments without departing from the essential attributes of the present invention. It is apparent that many modifications, substitutions, and additions may be made to the preferred embodiment while remaining within the scope of the appended claims, which should be interpreted as broadly as possible.

The embodiment of the invention in which an exclusive property or privilege is claimed is defined as follows:

1. A device to extract a fastener from a workpiece wherein the fastener has a head with a diameter and a predetermined direction of engagement with the workpiece, the device comprising:

a) a shaft having a first end and a second end;

b) said first end adapted to be received by a tool for imparting torque contrary to the fasteners direction of engagement;

c) said second end terminated in a cutting tool adapted to engage the fastener as said shaft is rotated;

d) a drill-bit portion proximal to the cutting tool and adapted to engage and bore into the fastener as said shaft is rotated;

e) a socket coaxial with and juxtaposed to said shaft at a point intermediate the first and second ends, said socket being substantially cylindrical and defining a rim for contacting a top surface of the workpiece, said socket further configured for engaging the head of the fastener; and wherein said socket comprises means to cut threads into the head of the fastener.

2. The device as recited in claim 1 wherein said drill bit potion defines a tapered region along a longitudinally extending section of said shaft.

3. The device as recited in claim 1 wherein said rim comprises means to reduce friction between the rim and said top surface of the workpiece.

4. The device as recited in claim 1 wherein said socket is further configured so that at least a fraction of said drill bit portion extends beyond said socket rim.

* * * * *

UNITED STATES PATENT AND TRADEMARK OFFICE

CERTIFICATE OF CORRECTION

PATENT NO. : 6,868,756 B2
DATED : March 22, 2005
INVENTOR(S) : Ira M. Kozak

It is certified that error appears in the above-identified patent and that said Letters Patent is hereby corrected as shown below:

Column 8,
Line 40, change "potion" to -- portion --

Signed and Sealed this

Seventeenth Day of May, 2005

JON W. DUDAS
*Director of the United States Patent and Trademark Office*